US007234966B2

(12) United States Patent
Choy

(10) Patent No.: US 7,234,966 B2
(45) Date of Patent: Jun. 26, 2007

(54) IC CARD CONNECTOR EQUIPPED WITH RESPECTIVE COVER DOORS AND ASSOCIATED ANTI-MISMATING DEVICE

(75) Inventor: Edmond Choy, Union City, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 276 days.

(21) Appl. No.: 11/095,277

(22) Filed: Mar. 30, 2005

(65) Prior Publication Data

US 2006/0228924 A1 Oct. 12, 2006

(51) Int. Cl.
*H01R 13/66* (2006.01)

(52) U.S. Cl. ..... 439/541.5; 439/188

(58) Field of Classification Search ..... 439/64, 439/159, 188, 540.1, 541.5
See application file for complete search history.

(56) References Cited

U.S. PATENT DOCUMENTS 5,574,625 A * 11/1996 Ohgami et al. ..... 361/684

6,120,322 A * 9/2000 Ho et al. ..... 439/541.5

* cited by examiner

*Primary Examiner*—Khiem Nguyen
(74) *Attorney, Agent, or Firm*—We Te Chung

(57) ABSTRACT

An electrical card connector (1) includes an insulative housing (10) enclosed by a metallic shield (28). The housing (10) defines a receiving space (18) with first and second sets of contacts (22, 24) disposed in the housing (10) and communicating with the receiving space (18). A protection door (40) is pivotally mounted to the housing (10) in an entrance opening (19) blocking the receiving space (18) from an exterior. A moveable locking member (60) releasably locks the protection door (40). The protection door (40) defines a cutout to leave a small entrance opening (46) to allow a small sized card (300) to be guidably and snugly inserted into the receiving space (18) wherein the protection door (40) is equipped with another small pivotal anti-dust door (56) to cover that small entrance opening (46). Therefore, the card connector (1) can mutually exclusively receive the large sized card (200) and the small sized card (300) guidably and reliably.

13 Claims, 24 Drawing Sheets

IC CARD CONNECTOR EQUIPPED WITH RESPECTIVE COVER DOORS AND ASSOCIATED ANTI-MISMATING DEVICE

The invention relates to IC card connectors, and particularly to the IC card connector equipped with anti-mismating means for assuring the different size/type cards will be correctly received in the correct positions through the respective doors which are associated with each other. This application relates to the copending application Ser. No. 11/001,261 filed Nov. 30, 2004.

It is popular to provide one single IC card connector with different sets of terminals at different locations to engage the different size/type IC cards which mutually exclusively enter the common receiving space defined in said IC card connector via the same entrance opening. Understandably, the housing of the IC card is provided some key/keyway in the guiding channels to guidably retain the inserted cards in position; anyhow, sometimes a small dimensioned card may be inadvertently inserted into the entrance opening in an improper tilted manner that it may be uncontrollably led to an incorrect position, thus either damaging the terminals or being damaged by the terminals. The safest way is to provide different spaces and/or different entrance openings in the IC connector, while it will increase the total thickness thereof that is opposite to the miniaturization trend. Accordingly, it is desired to provide a safe structure for the IC card connector to regulate different cards' insertion. Some attempts might have been considered, including having a set of terminal module being moveably arranged relative to the other, either linearly or rotatably, while such attempts are so complicated that either no space in the notebook computer to compliantly allow such a movement, or reliability is doubtful.

In fact, in the electrical connector field, for the modular jack connectors there are several different workable approaches to prevent a small plug from incorrectly being inserted into a large sized modular jack which is basically fit for a large plug, for example, U.S. Pat. Nos. 6,257,935 and 6,319,070. Moreover, for the IC card connector as mentioned above, U.S. Pat. No. 5,035,633 specifically discloses a protection member which is located at the entrance opening of the IC card connector and can be moved either linearly or pivotally to allow the corresponding IC card to be inserted into the card connector for mating under a condition that the protection member is controlled by a locking member which moveably releasably locks the protection member while can be released by the inserted card when the correctly sized IC card is inserted into the card entrance opening.

Anyhow, sometimes a small sized card is still required to be inserted into the combo type card connector for mating with the corresponding contacts in the card connector. Therefore, it is expected to modify the protection member of the aforementioned U.S. Pat. No. 5,035,633 for providing an IC card connector with a modified protection device which is capable of retaining a small sized card in position when the small sized card is inserted into the receiving space for mating with the corresponding contacts while not obstructing insertion of a large sized card when the large sized card is inserted into the receiving space for mating with the corresponding contacts.

SUMMARY OF THE INVENTION

In an aspect, an electrical card connector includes an insulative housing enclosed by a metallic shield. The housing defines a receiving space with first and second sets of contacts disposed in the housing and communicating with the receiving space. A protection door is pivotally mounted to the housing in an entrance opening blocking the receiving space from an exterior. A moveable locking member releasably locks the protection door. The protection door defines a cutout to leave a small entrance opening to allow a small sized card to be guidably and snugly inserted into the receiving space wherein the protection door is equipped with another small pivotal anti-dust door to cover that small entrance opening. Therefore, the card connector can mutually exclusively receive the large sized card and the small sized card guidably and reliably.

Similar to the aforementioned U.S. Pat. No. 5,035,633, the protection door is equipped with the locking member to prevent movement of the protection door unless the correctly sized card is inserted into the receiving space.

Different from the aforementioned U.S. Pat. No. 5,035,633, the protection door is further equipped with the guiding rail structure on the back of the small entrance opening to guidably support insertion of the small card so that the large card can be guided and retained in position by the housing while the small card can be guided and retained in position by the guiding rail structure of the protection door without involvement of the housing.

DETAILED DESCRIPTION OF THE PREFERRED EMBODIMENTS

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 1A:
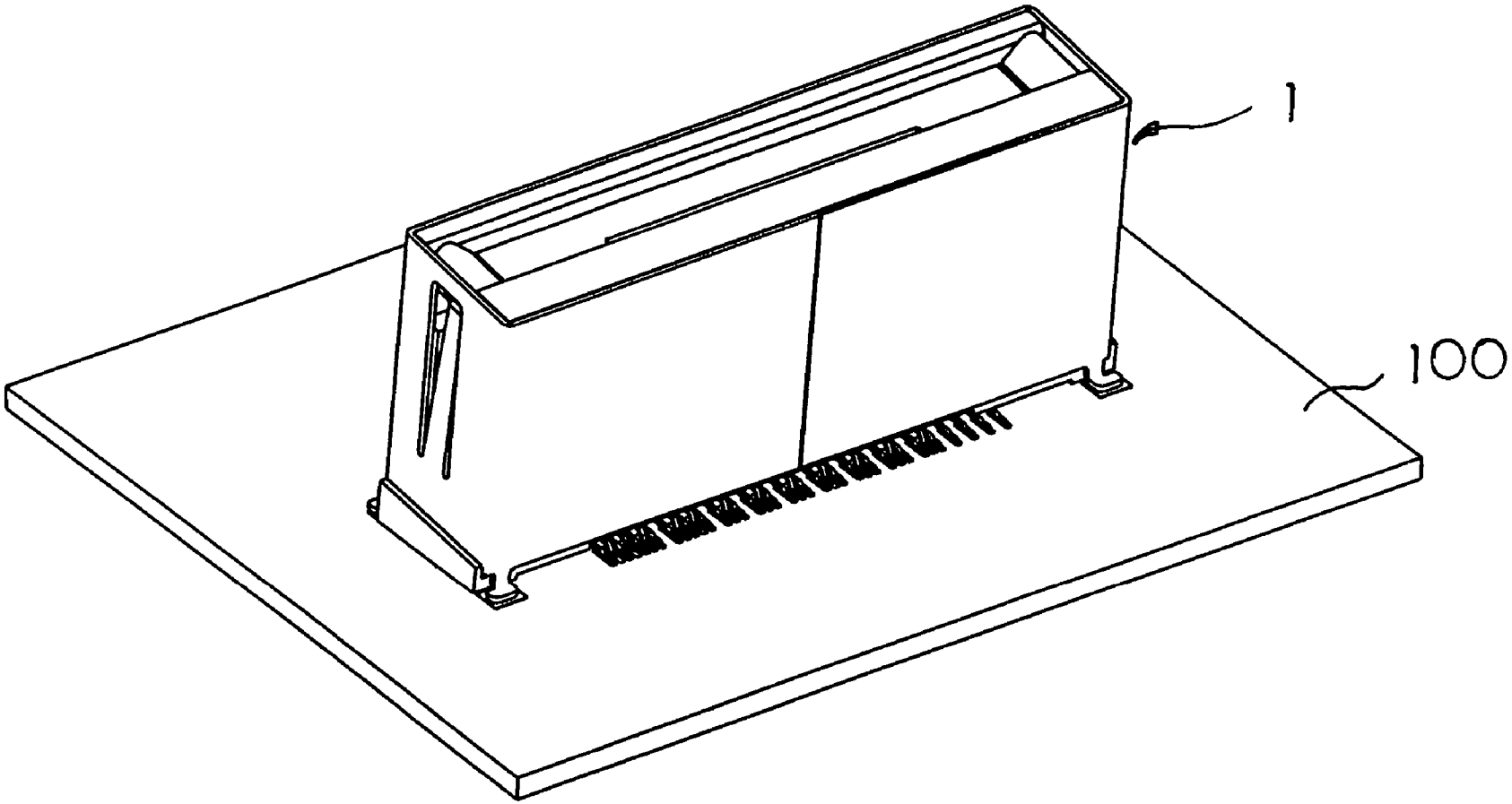
FIG. 1(A) is perspective view of the card connector assembly having the electrical card connector mounted on the printed circuit board.
Figure 1B:
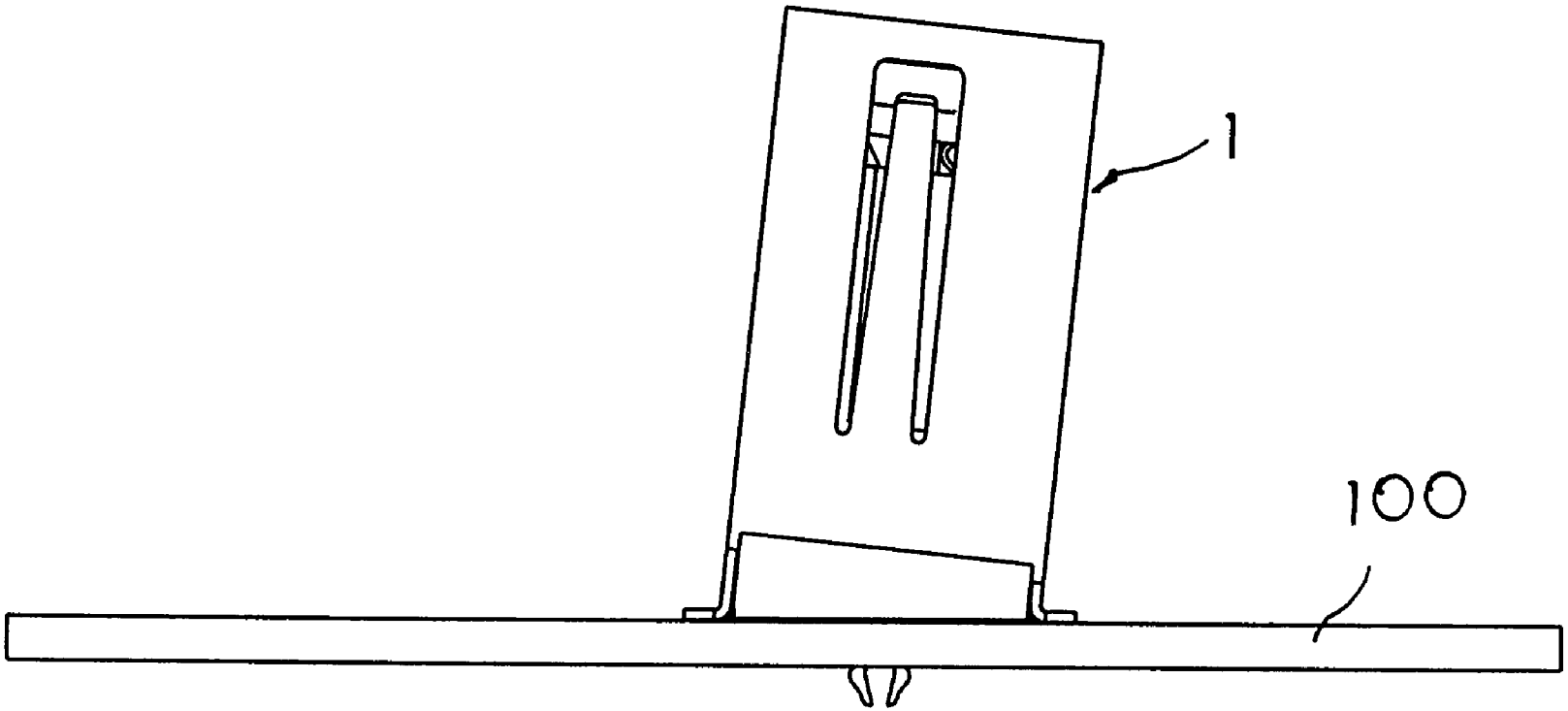
FIG. 1(B) is a side view of the card connector assembly of FIG. 1(A) to show that the connector is essentially slightly oblique to the printed circuit board.
Figure 2A:
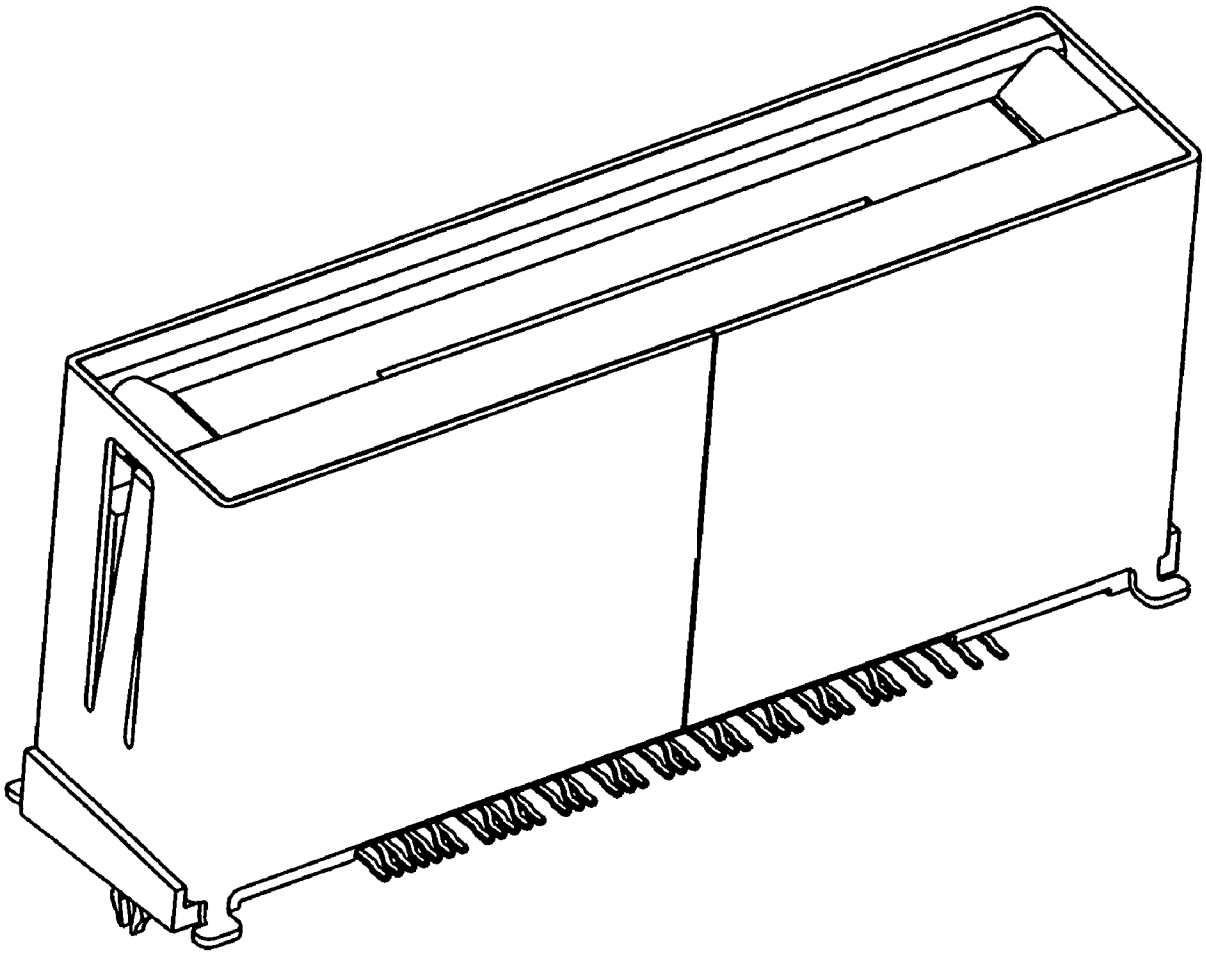
FIG. 2(A) is a perspective view of a freely standing assembled card connector.
Figure 2B:
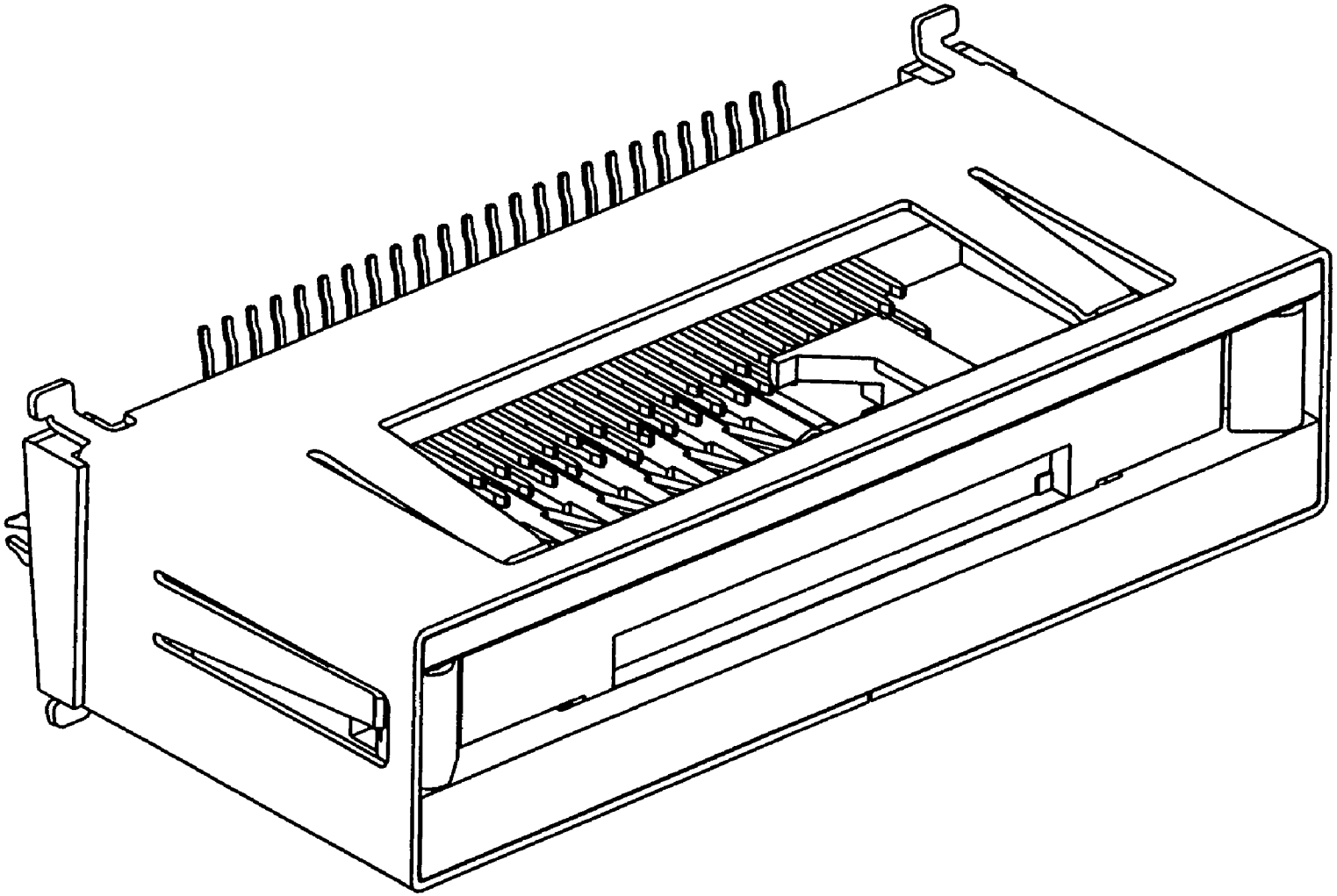
FIG. 2(B) is another perspective view of the card connector of FIG. 2(A) arranged in a horizontal manner for easy illustration in the following drawings.
Figure 3:
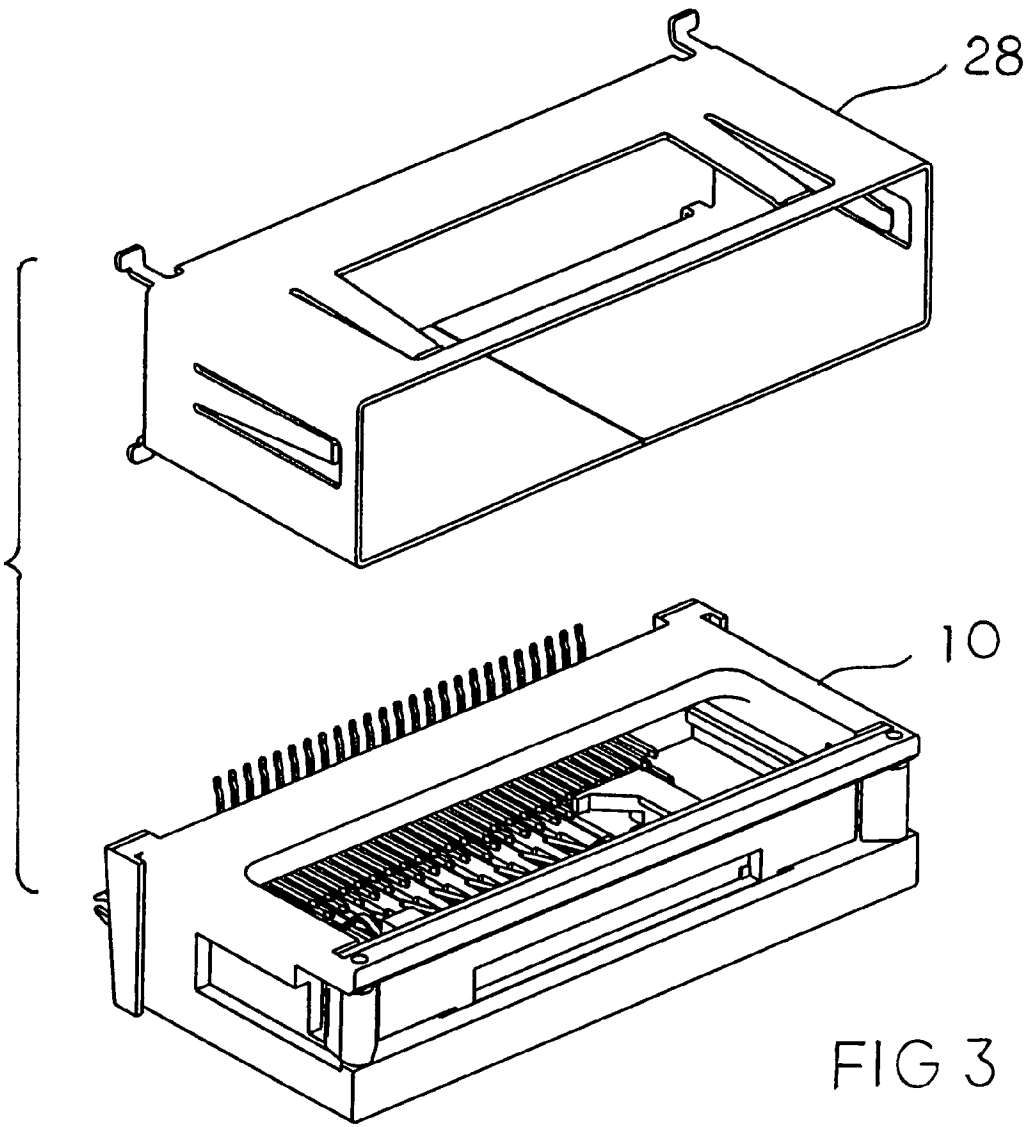
FIG. 3 is a roughly exploded perspective view of the card connector of FIG. 3 by detaching the shield from the housing.
Figure 4:
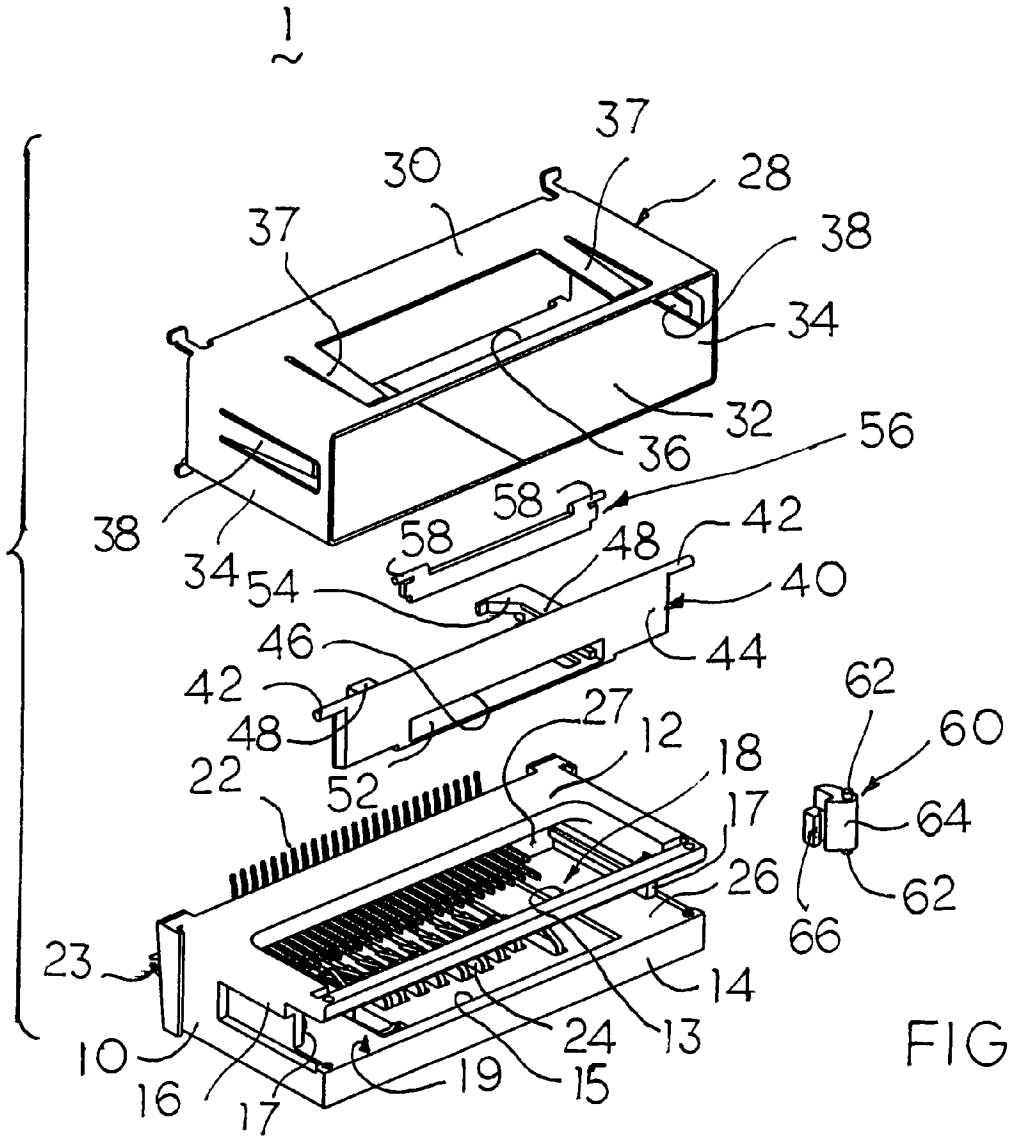
FIG. 4 is a relatively detailed exploded perspective view of the card connector of FIG. 3 to show the insulative housing and the protection door, the pivotal door, and locking member associated therewith.
Figure 5:
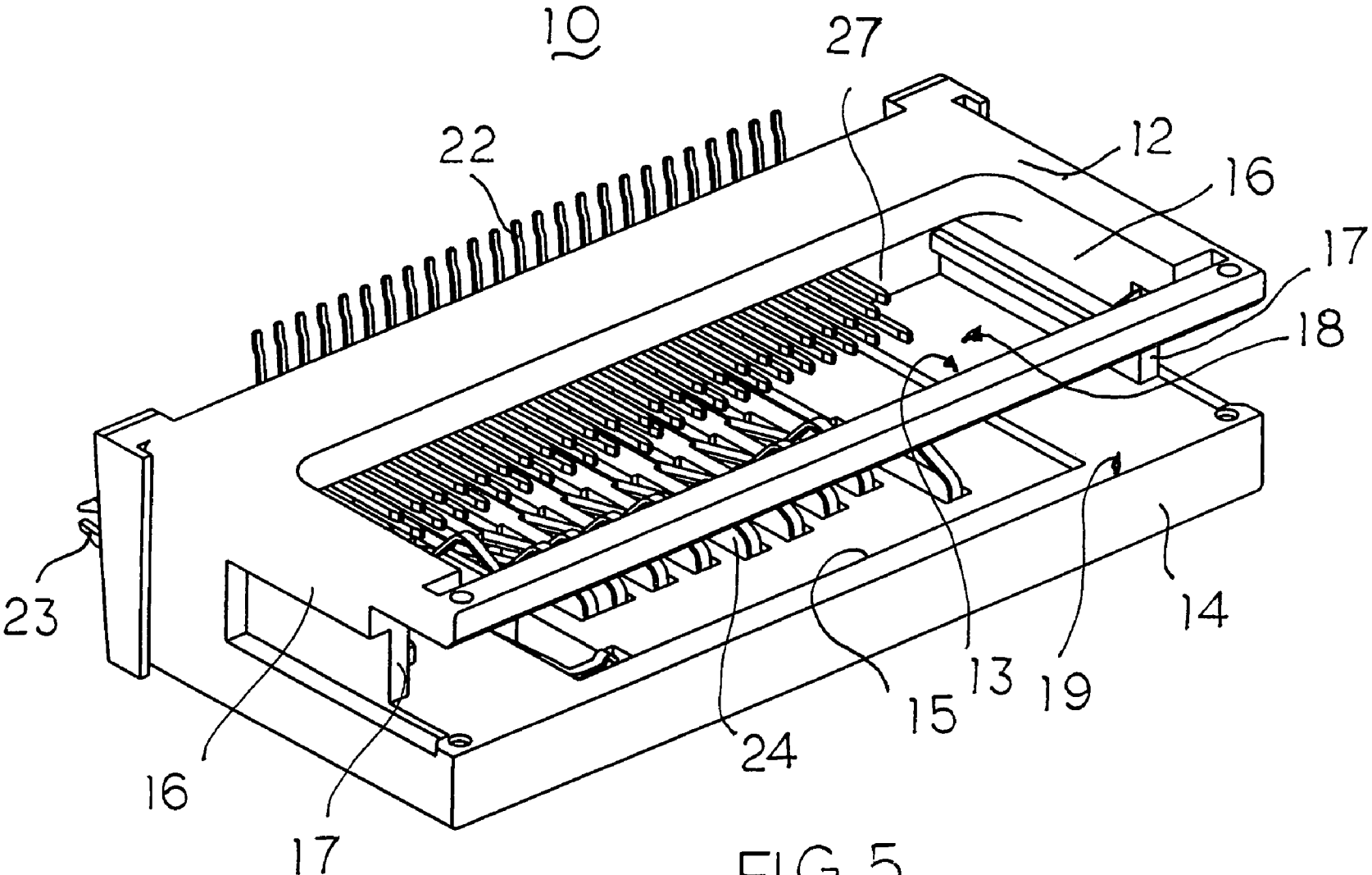
FIG. 5 is an enlarged perspective view of the housing of FIG. 4 including the associated contacts therein.
Figure 6:
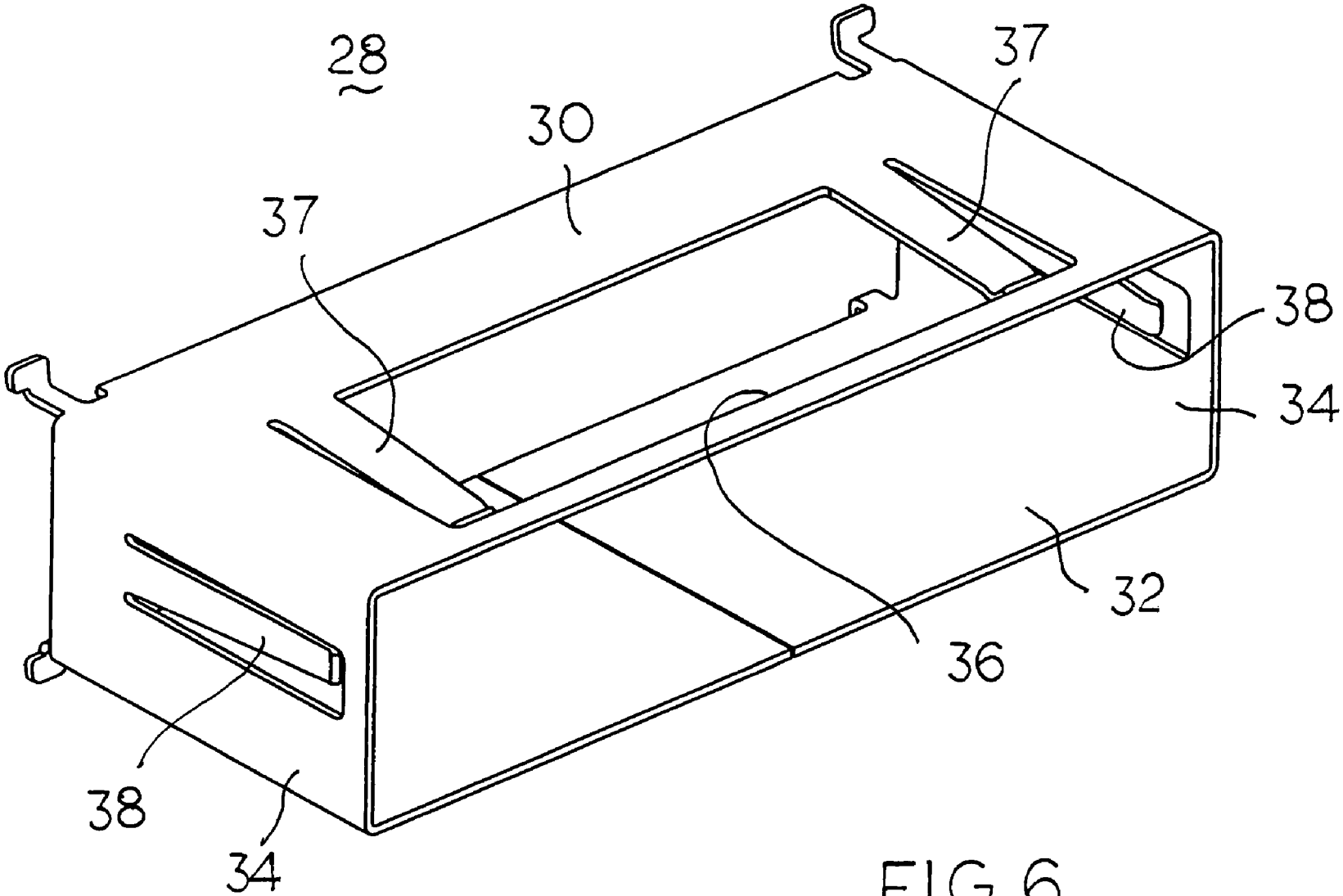
FIG. 6 is an enlarged perspective view of the metallic shield of FIG. 4.
Figure 7A:
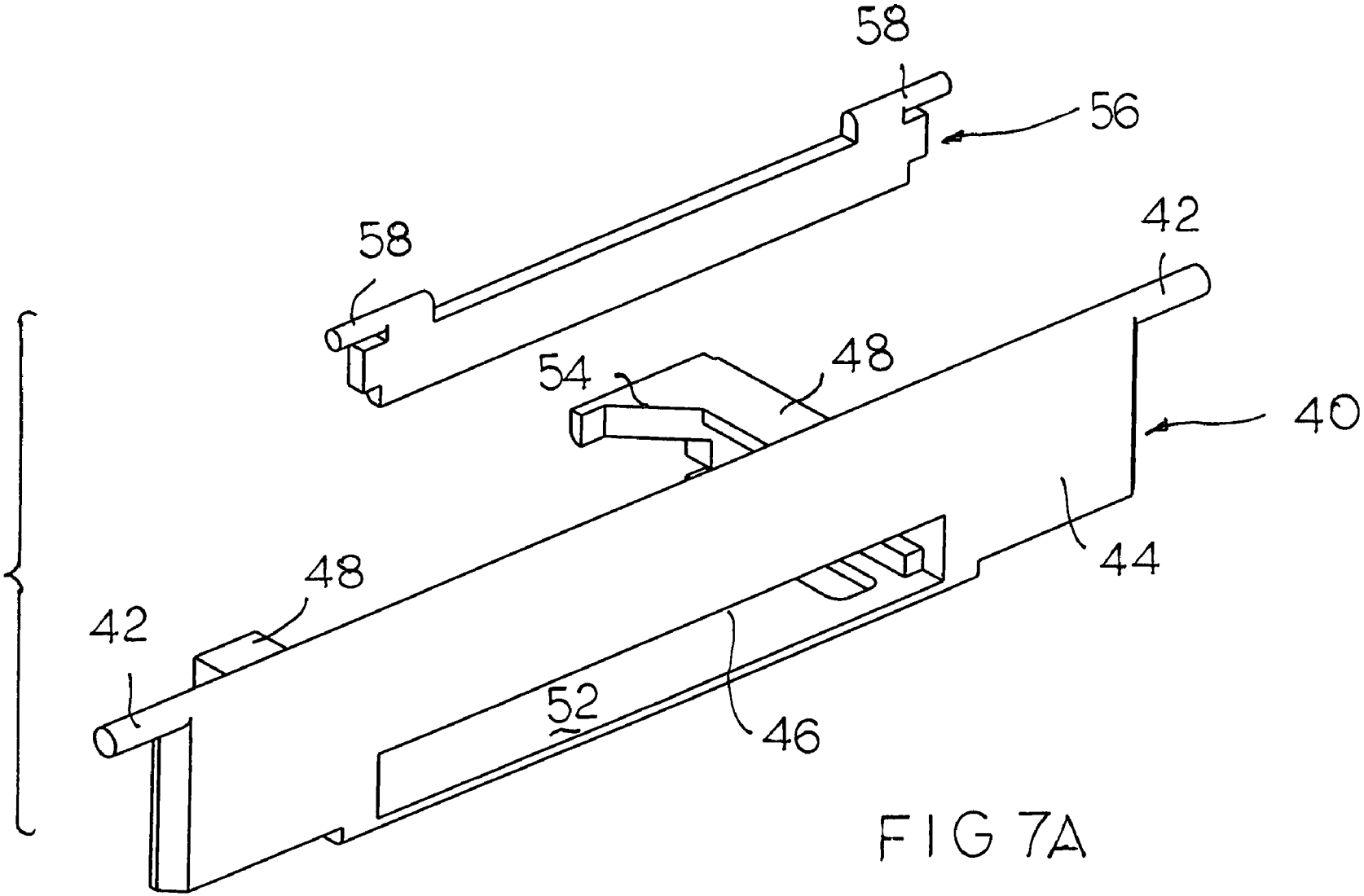
FIG. 7(A) is an enlarged front perspective view of the protection door and the associated pivotal door of FIG. 4, disassembled from each other.
Figure 7B:
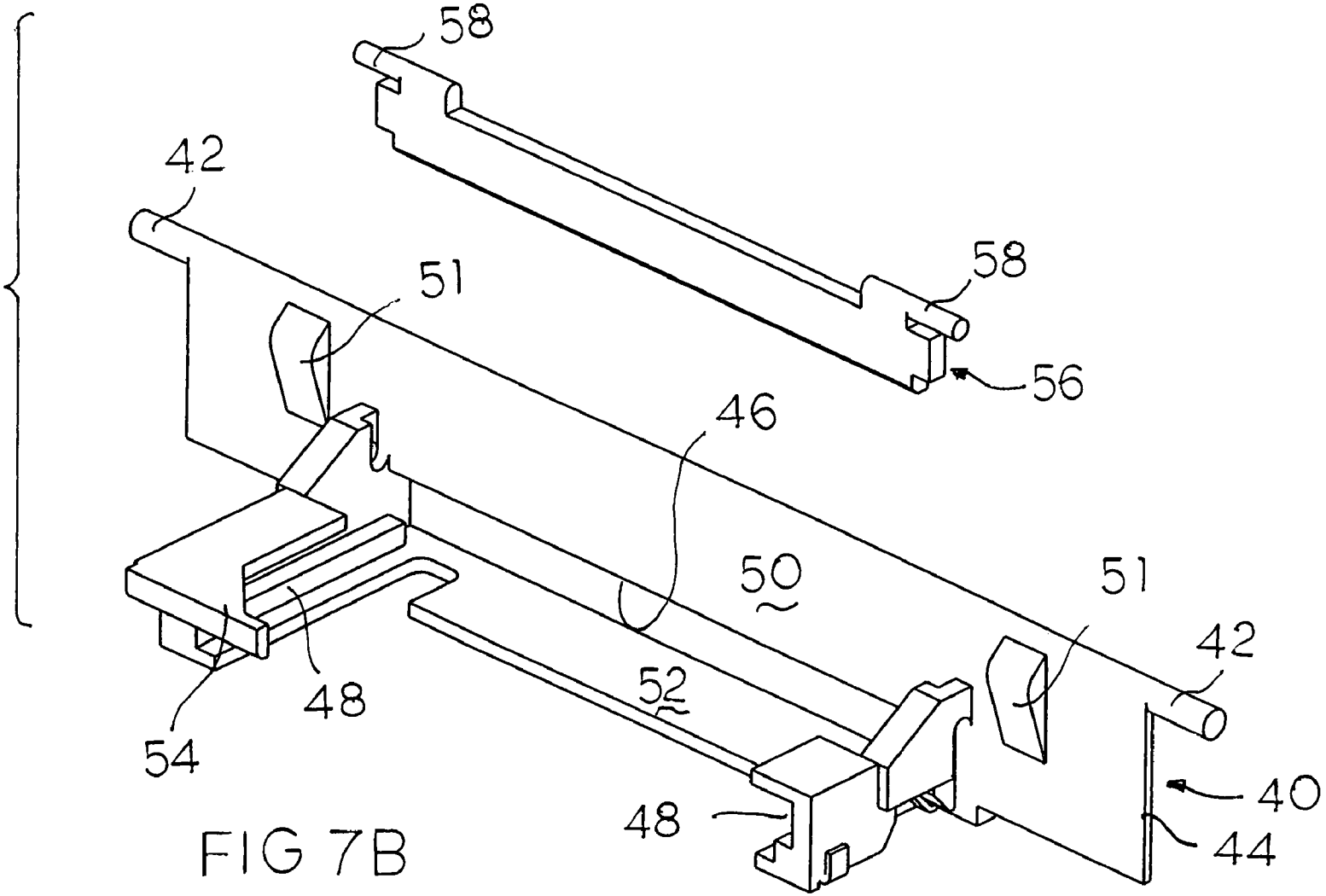
FIG. 7(B) is an enlarged rear perspective view of the protection door and the associated pivotal door of FIG. 7(A).
Figure 12A:
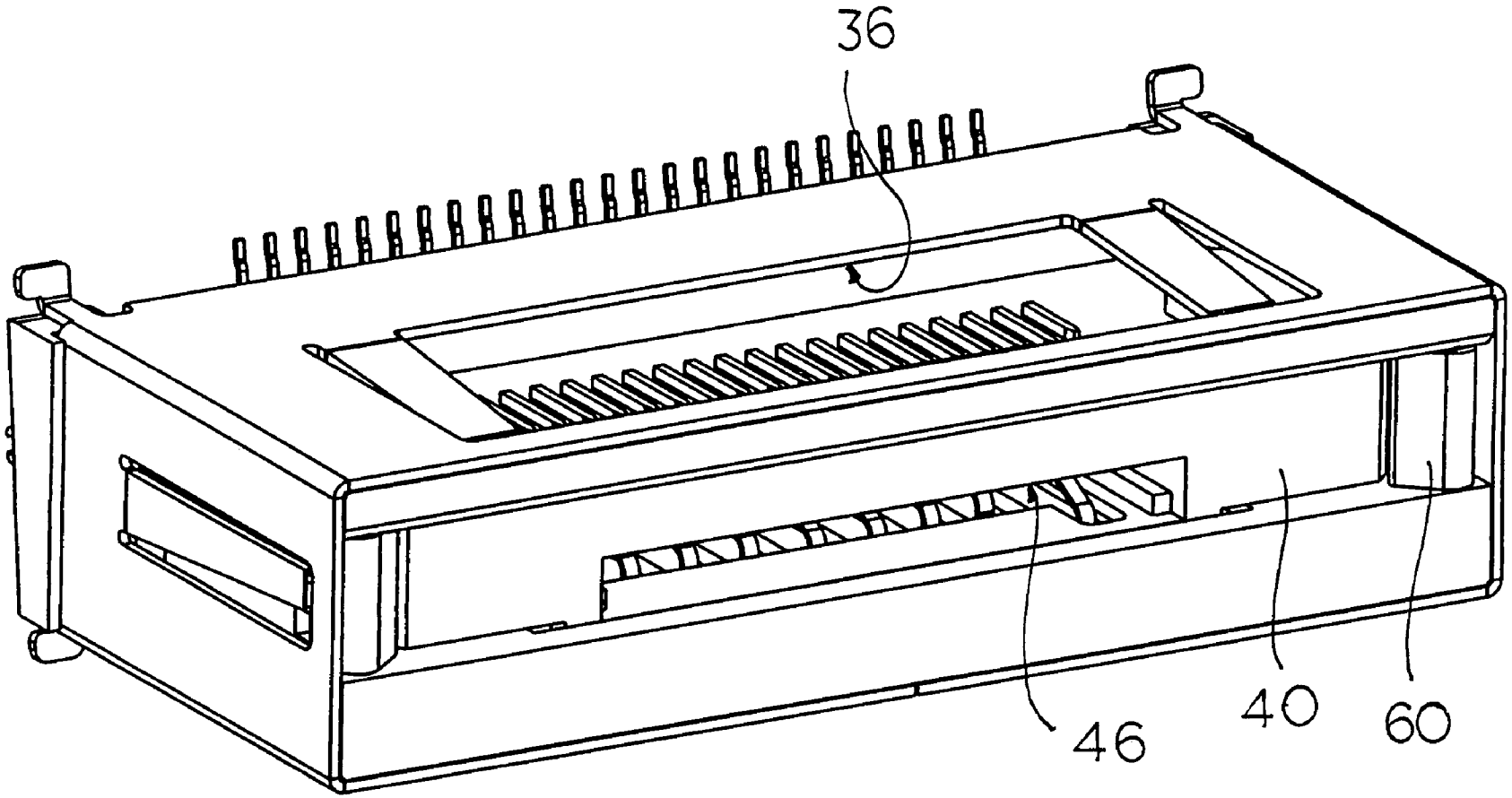
FIG. 12(A) is a front perspective view of the assembled connector of FIG. 4 to show the pivotal door is rotated for exposing the small entrance opening for receiving a small card in the receiving space.
Figure 12B:
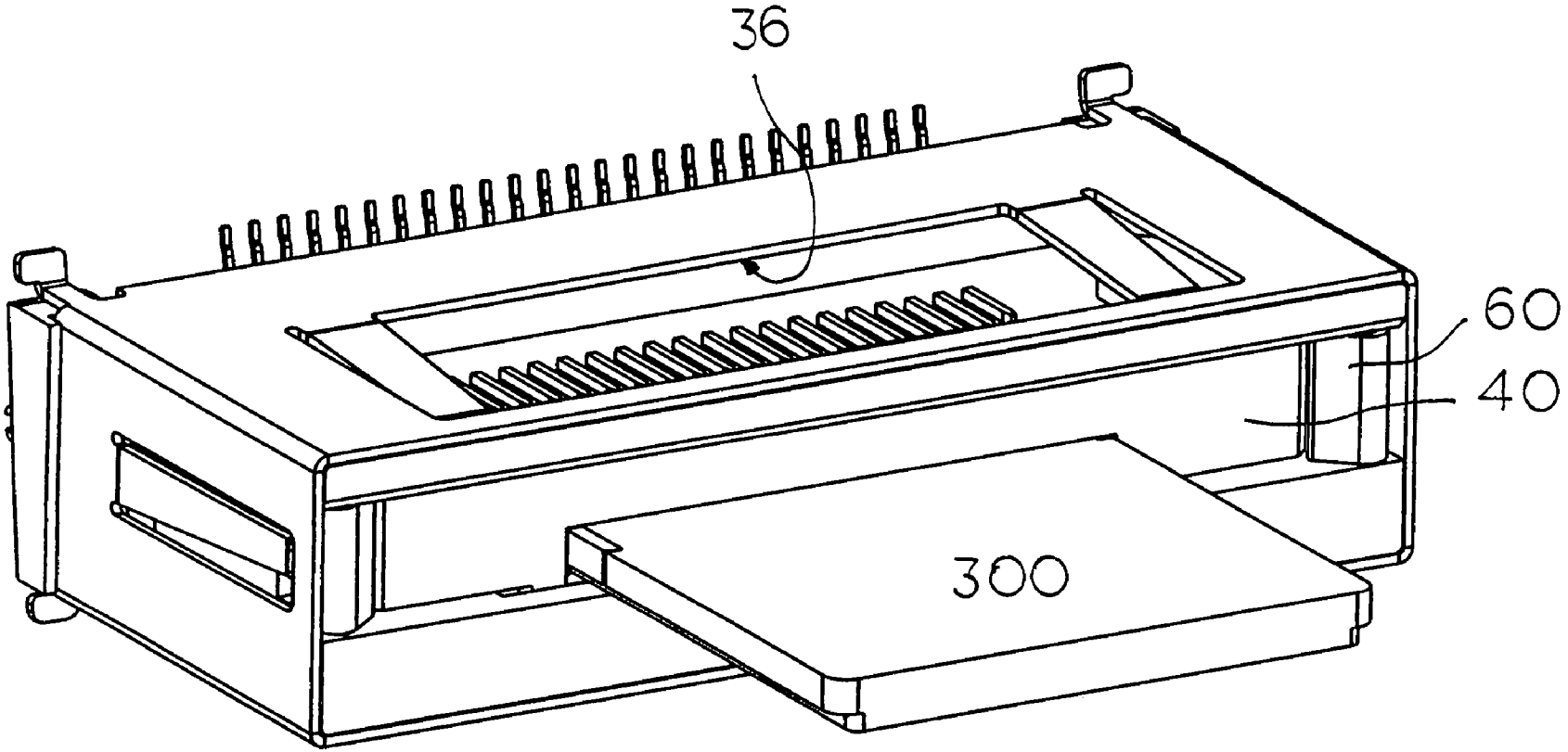
FIG. 12(B) is a front perspective view of the connector assembly having the small card received in the receiving space through said small entrance opening of the connector of FIG. 12(A).
Figure 12C:
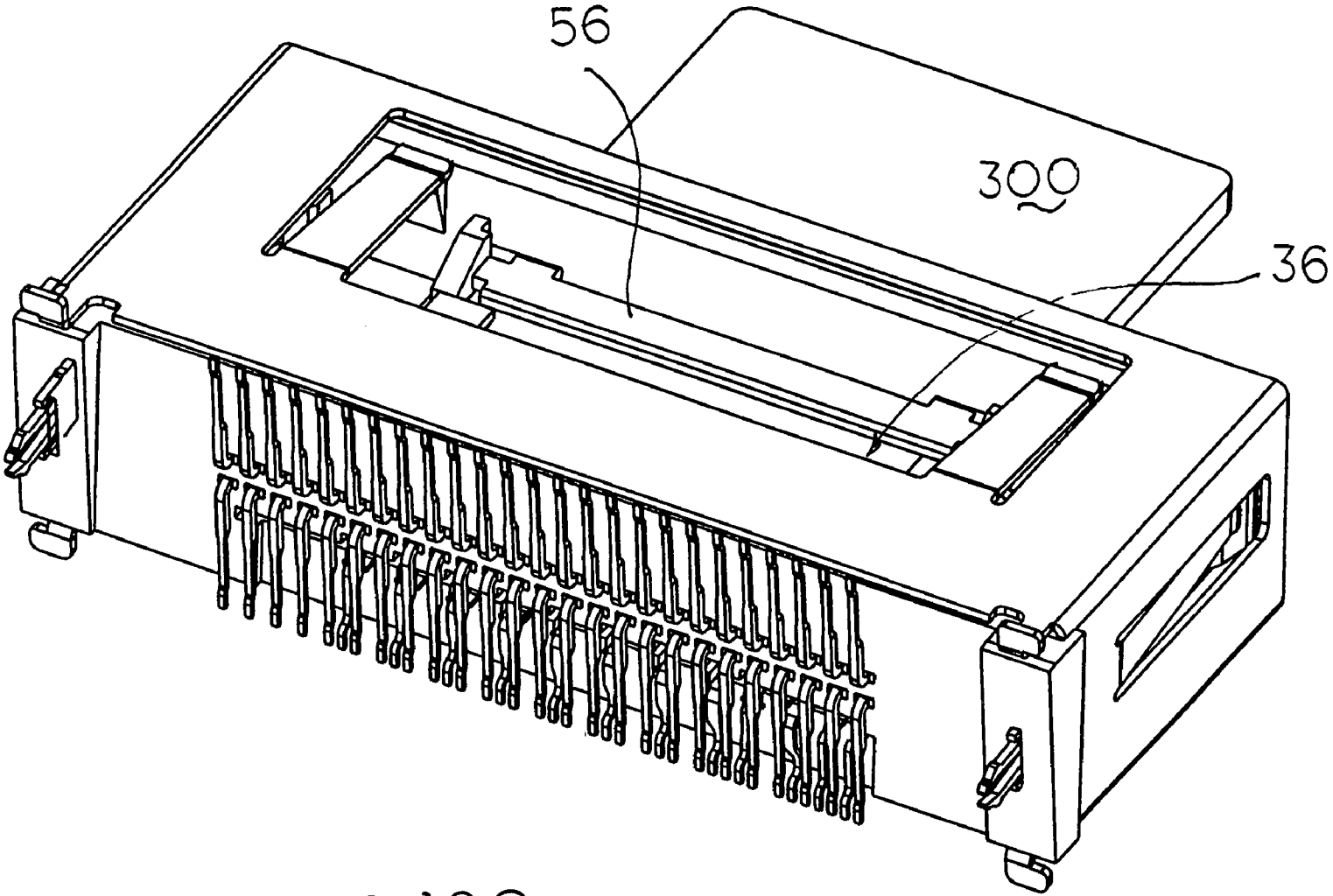
FIG. 12(C) is a rear perspective view of the connector assembly of FIG. 12(B).
Figure 12D:
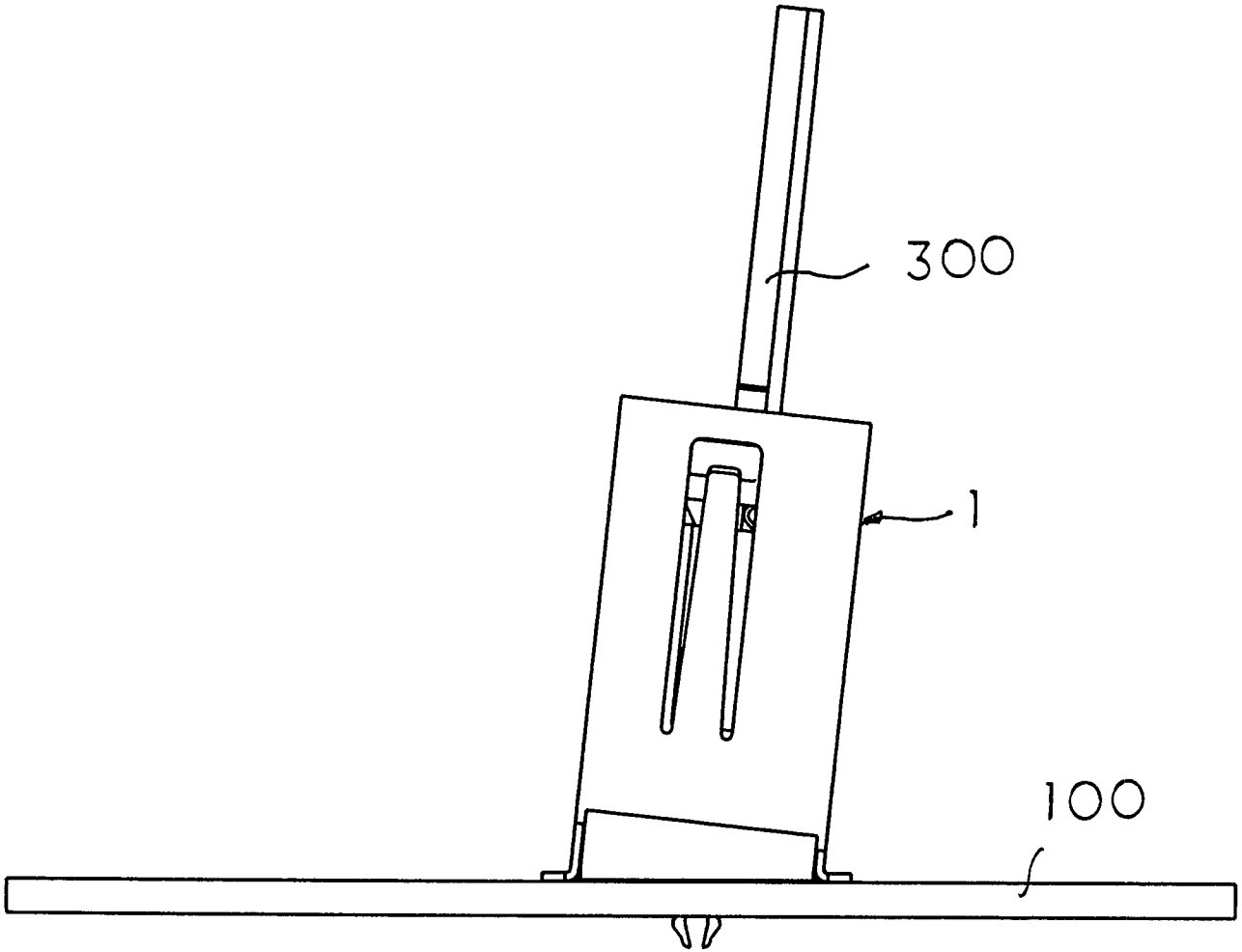
FIG. 12(D) is a side view of the connector assembly of FIG. 12(B) with the associated printed circuit board of FIG. 1(B).
Figure 13A:
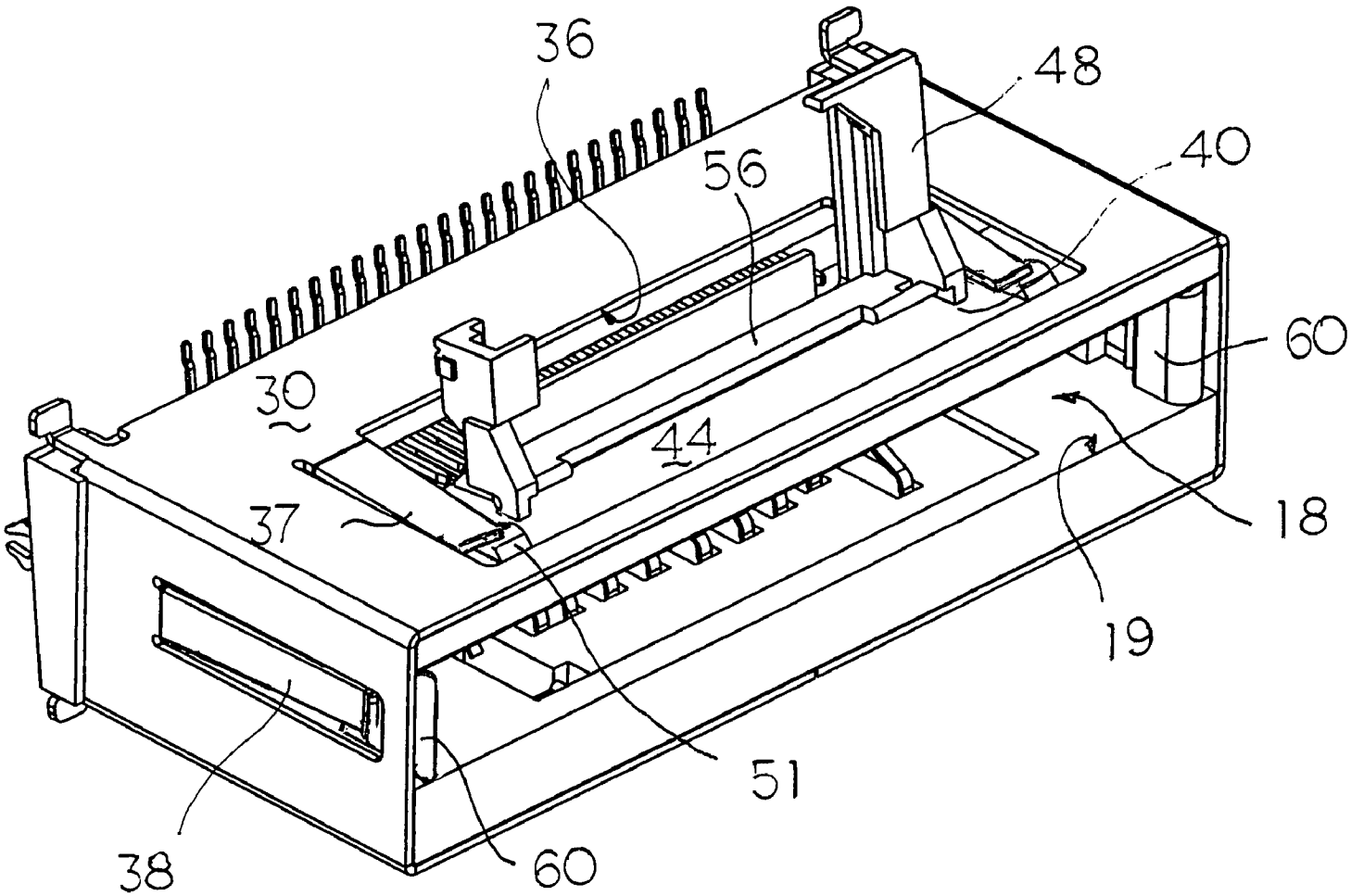
FIG. 13(A) is a front perspective view of the assembled connector of FIG. 4 to show the protection door is rotated upwardly for exposing the large entrance opening for receiving a large card in the receiving space.
Figure 13B:
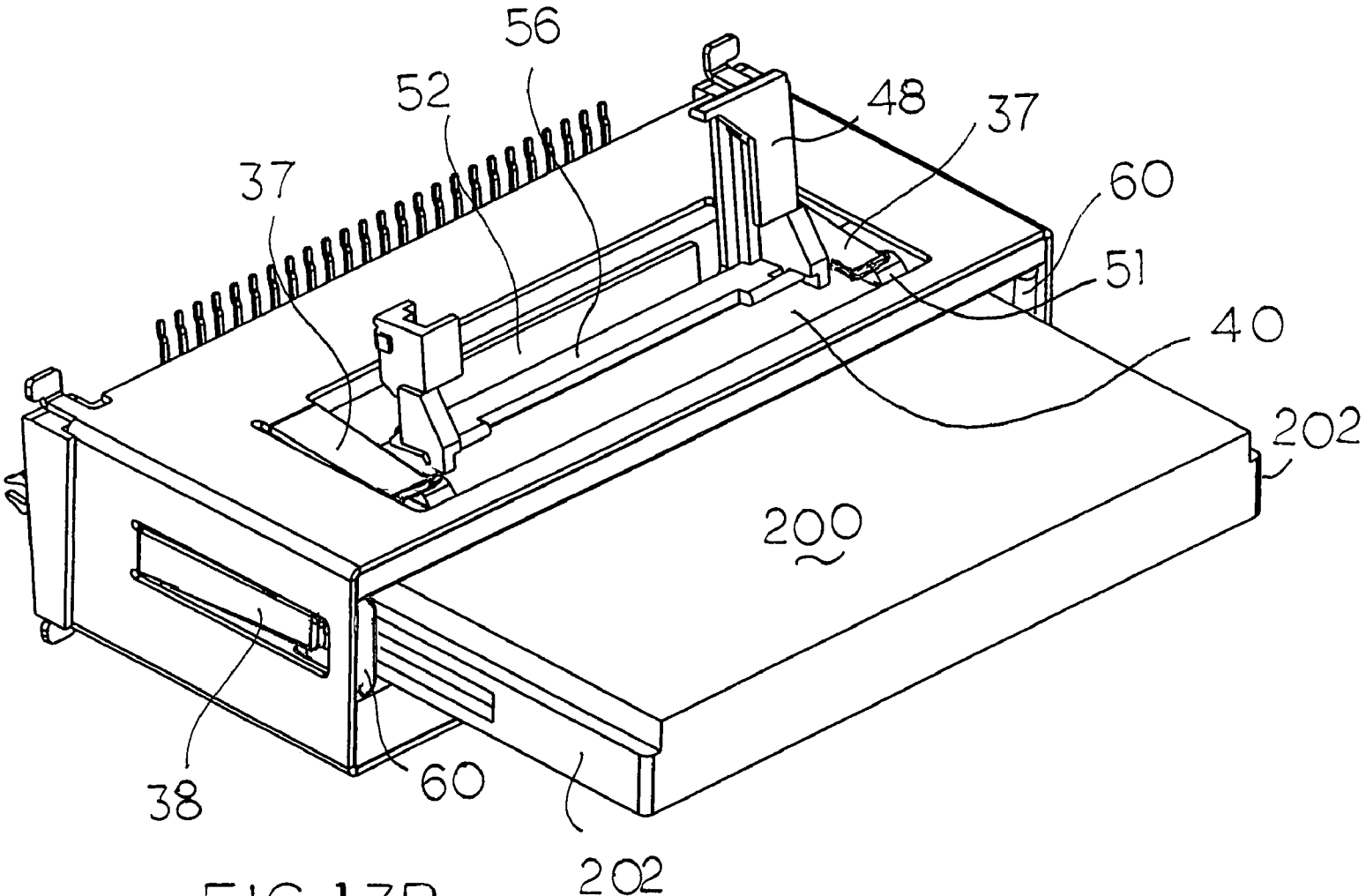
FIG. 13(B) is a front perspective view of the connector assembly having the large card received in the receiving space through the large entrance opening.
Figure 14:
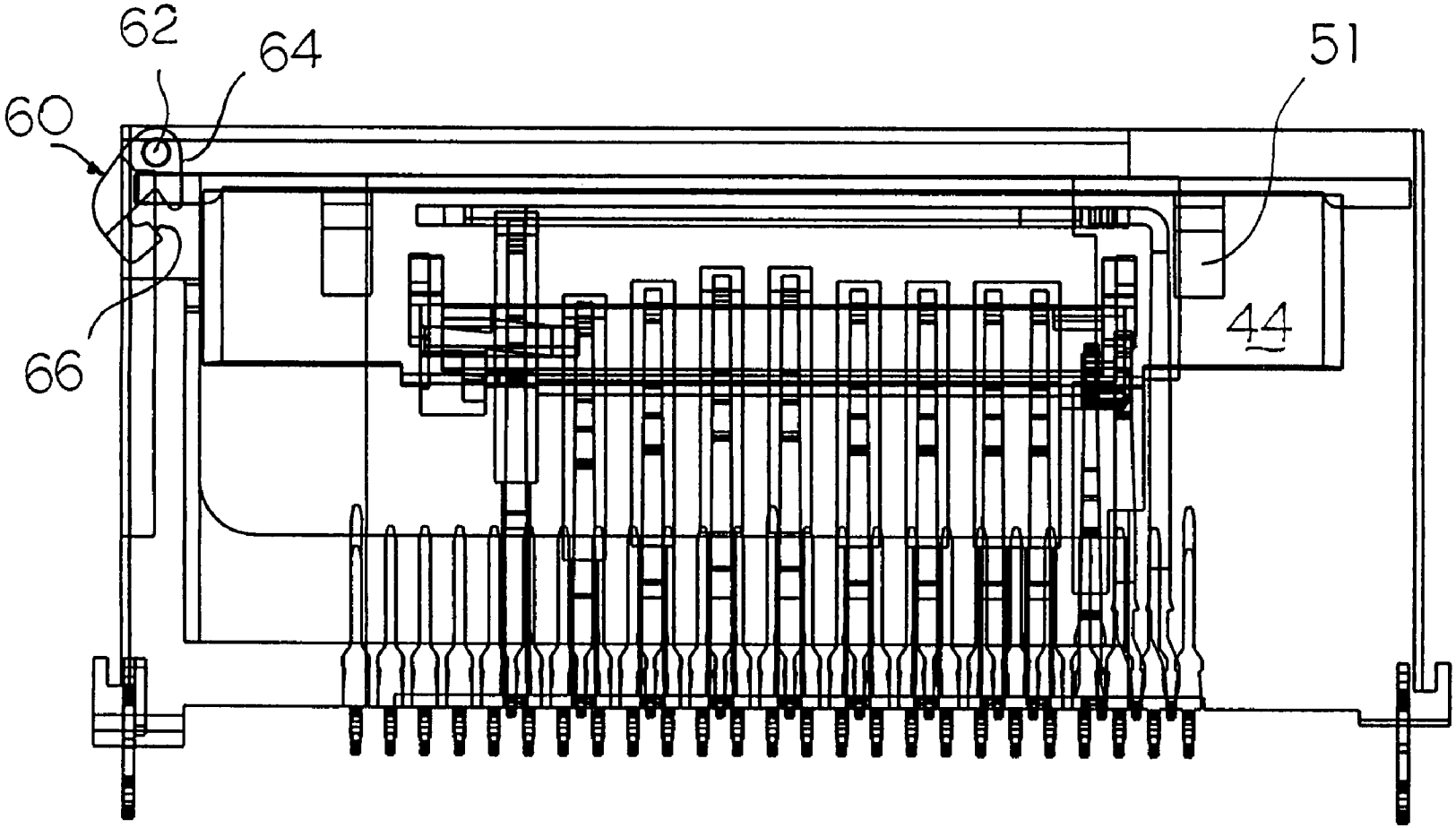
FIG. 14 is a plane view of the connector of FIG. 4 to illustrate the locking member is in an actuated position by the large card so as to release the locked protection door.

It will be noted here that for a better understanding, most of like components are designated by like reference numerals throughout the various figures in the embodiments. Attention is directed to FIGS. 1 and 2 wherein an electrical card connector 1 is mounted on a printed circuit board 100. Referring to FIG. 2(A) to FIG. 9, the card connector 1 includes an insulative housing 10 having opposite top wall 12 and bottom wall 14, opposite two side walls 16, and a rear wall 27 commonly define a receiving space 18 in the housing 10. A first set of contacts 22 are disposed on the rear wall 27 and forwardly extending into the receiving space 18 for mating with a large card 200 (FIG. 13(B)). A second set of contacts 24 are disposed on the bottom wall 14 and upwardly extending above an tipper face 26 of the bottom wall 14 and into the receiving space 18 for mating with a small card 300 (FIG. 12(B)). A large entrance opening 19 is formed in a front end of the housing 10 and in front of and in communication with the receiving space 18. A pair of boardlocks 23 are attached on an undersurface of the housing 10 for mounting the connector 1 to the printed circuit board 100.

A metallic shield 28 encloses the housing 10 and includes opposite top plate 30 and bottom plate 32, and opposite two side plates 34. The top plate forms an large opening 36 therein and two resilient arms 37 thereon beside the large opening 36, and each of the side plate 34 forms a resilient arm 38 thereon.

A protection door 40 having two opposite pivots 42 thereon, is pivotally mounted to a front end of the housing 10 to movably block the large entrance opening 19. The protection door 40 includes a front plate 44 defining a cutout to form a small entrance opening 46 therein wherein in this preferred embodiment the small entrance opening 46 is essentially overlapped with a portion of the large entrance opening 19. A pair of guiding rails 48 extend rearwardly from a back surface 50 of the front plate 44 at positions right beside the small entrance opening 46. A supporting bottom plate 52 is integrally extends rearward from a bottom edge of the front plate 44 so as to cooperate with the pair of guiding rails 48 to hold the inserted small card 300 in position. A wedged stopper 54 is formed at the rear end of one of the guiding rails 48 for engagement with a wedged distal end of the small card 300.

A pivotal door 56 having two pivots 58 thereon, is pivotally mounted to on the back surface 50 of the front plate 44 of the protection door 40 adjacent to the small entrance opening 46. The pivotal door 56 moveably blocks the small entrance opening 46 on the back surface 50 of the front plate 44.

The top wall 12 of the housing 10 defines therein an opening 13 located in alignment with the large opening 36 and cooperating with the large opening 36 to accommodate the protection door 40 therein when the protection door 40 is upwardly raised by the large card 200. The bottom wall 14 of the housing 10 defines therein a recess 15 to accommodate the supporting bottom plate 52 when the protection door 40 is in the locked horizontal position where only the small card 300 can be inserted into the receiving space 18 through the small entrance opening 46. A pair of cutoffs 17 are formed in front ends of the corresponding side walls 16, respectively. A pair of locking members 60 (only one shown in FIG. 4) having two pivots 62 thereon, are pivotally mounted in the corresponding cutoffs 17, respectively.

Each of the locking member 60 includes a confrontation surface 64, at the front, adapted to be actuated to move by a large card 200, and a blocking surface 66, at the back, adapted to block rearward movement of the protection door 40 if the locking member 60 is not actuated by insertion of the large card 200.

Referring to FIGS. 11–13(B), to the connector 1 when no card is received in the receiving space 18, the protection door 40 is in a vertical or non-rotation position to cover the large entrance opening 19 under a condition that the pivotal door 56 is also in a vertical or non-rotation position to cover the small entrance opening 46. Under this situation, when the correctly sized large card 200 is inserted into the receiving space 18 through the large entrance opening 19, two side edges 202 of the card 200 confront and push away the confrontation surface 64 of the blocking member 60 to have the corresponding blocking member 60 outwardly rotated so as to have the blocking surface 66 disengaged from the protection door 40. Therefore, the further rearward movement of the large card 200 further pushes and upwardly raises the protection door 40 under a pivotal manner to have the front plate 44 essentially located in a horizontal position. As mentioned above, under this condition the guiding rails 48 extends through both the opening 13 of the top wall 12 and the large opening 36 of the shield 28.

Oppositely, if no large card 200 is available, a small card 300 is also allowed to be inserted into the receiving space 18 via the small entrance opening 46 wherein the pivotal door 56 is upwardly raised by the inserted small card 300 to a horizontal position under a condition that the protection door 40 is locked by the locking member 60, and the inserted small card 300 is snugly retained by the pair of guiding rails 48 in the transverse direction, and by the supporting bottom plate 52 and the raised pivotal door 56 in the vertical direction.

Once the large card 200 is withdrawn from the housing 10 via a reverse procedure, the protection door 40 is pushed back to the original non-rotation position by the restoration force generated by the resilient arms 37 which are urged by the corresponding protrusions 51 on the back surface 50 of the front plate 44 of the protection door 40 when the large card 200 is received in the receiving space 18. On the other hand, the locking members 60 are also pushed inward back to the original non-rotation position by the resilient arms 38, respectively.

Figure 8A:
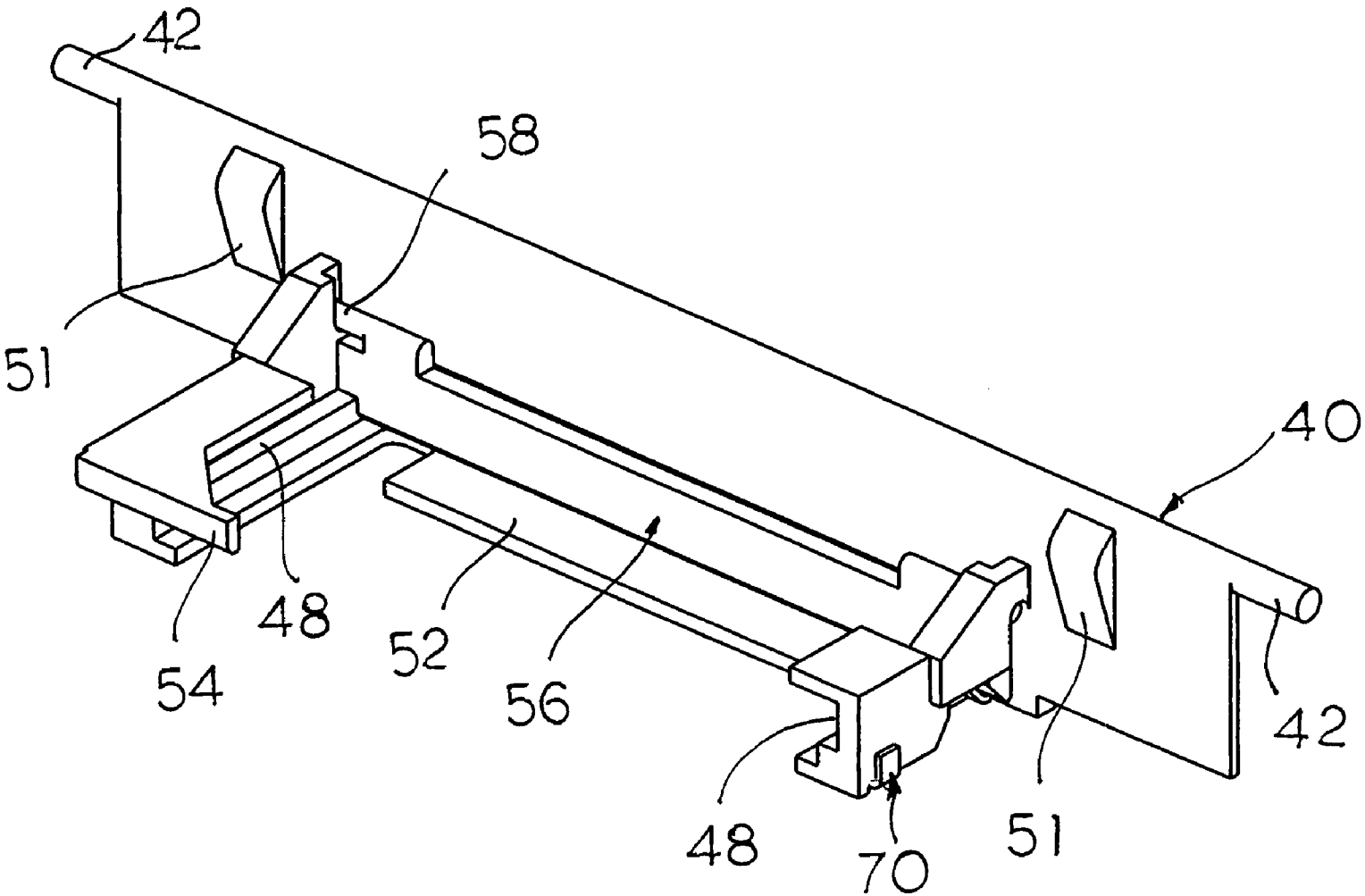
FIG. 8(A) is an enlarged rear perspective view of the assembled protection door and pivotal door of FIG. 7(B) wherein the pivotal door is in a closed state.
Figure 8B:
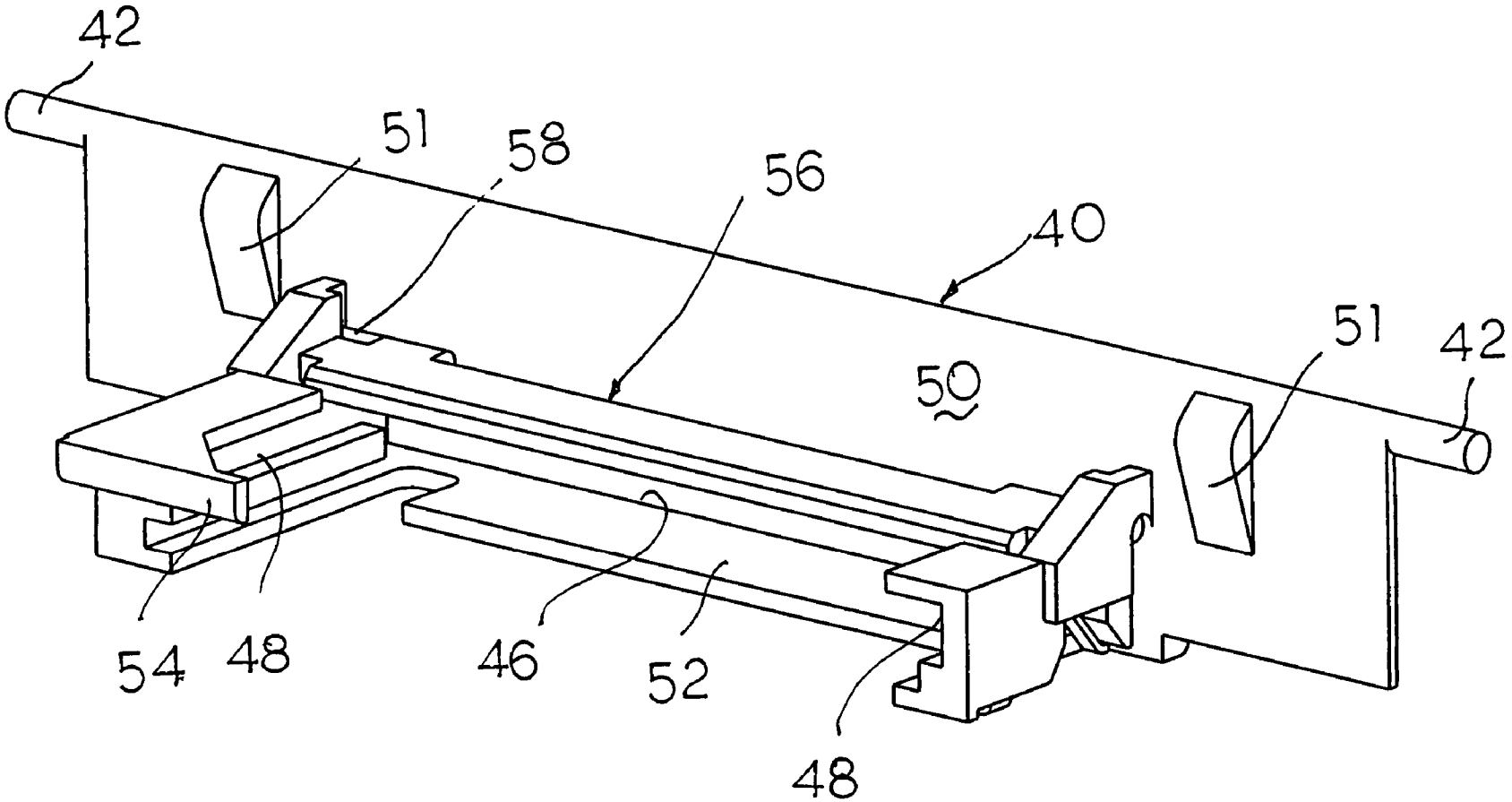
FIG. 8(B) is an enlarged rear perspective view of the assembled protection door and pivotal door of FIG. 8(A) wherein the pivotal door is in an open state.
Figure 8C:
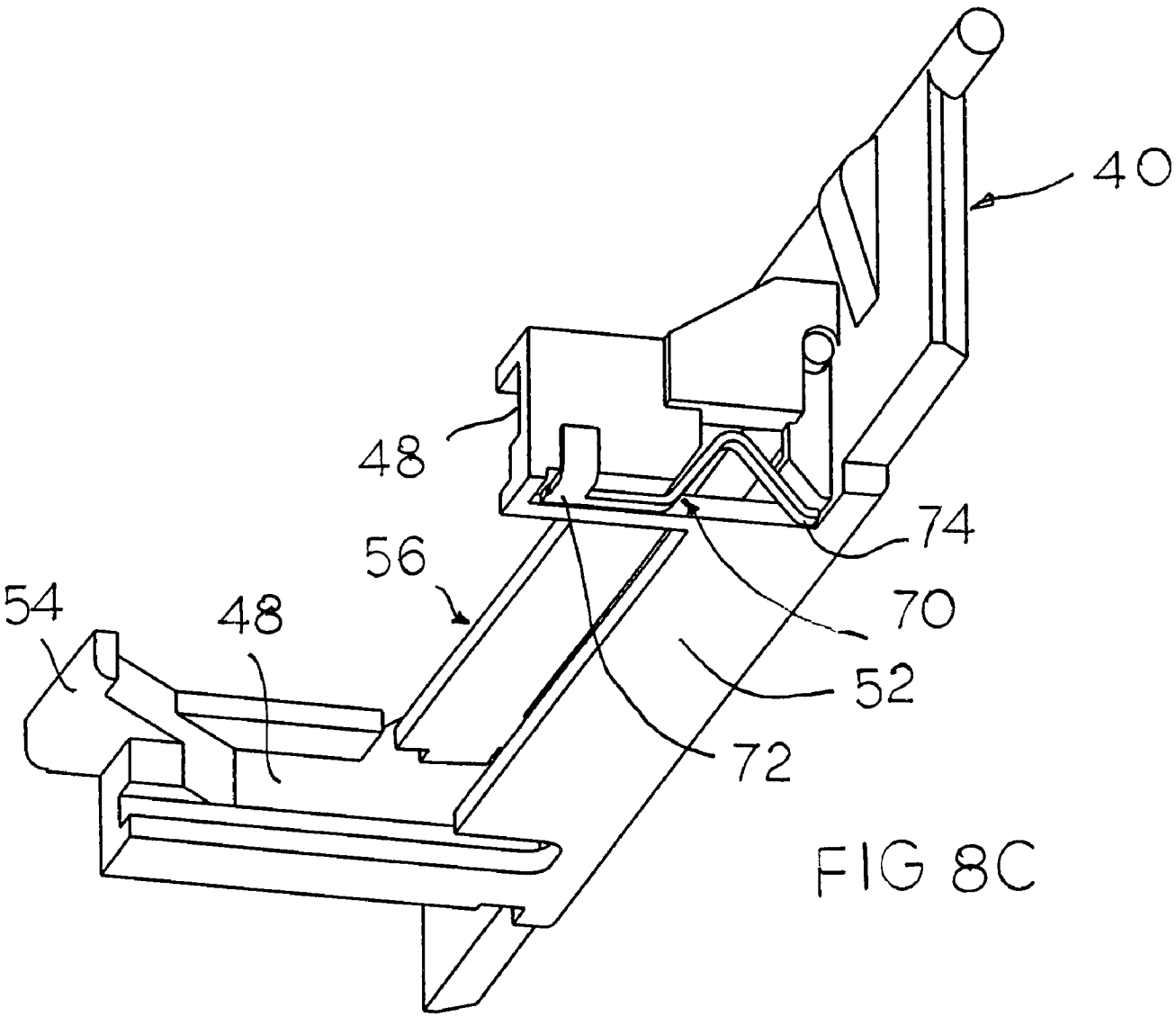
FIG. 8(C) is another enlarged rear perspective view of the assembled protection door and pivotal door of FIG. 8(B) to show the switch contact associated with the protection door.
Figure 9:
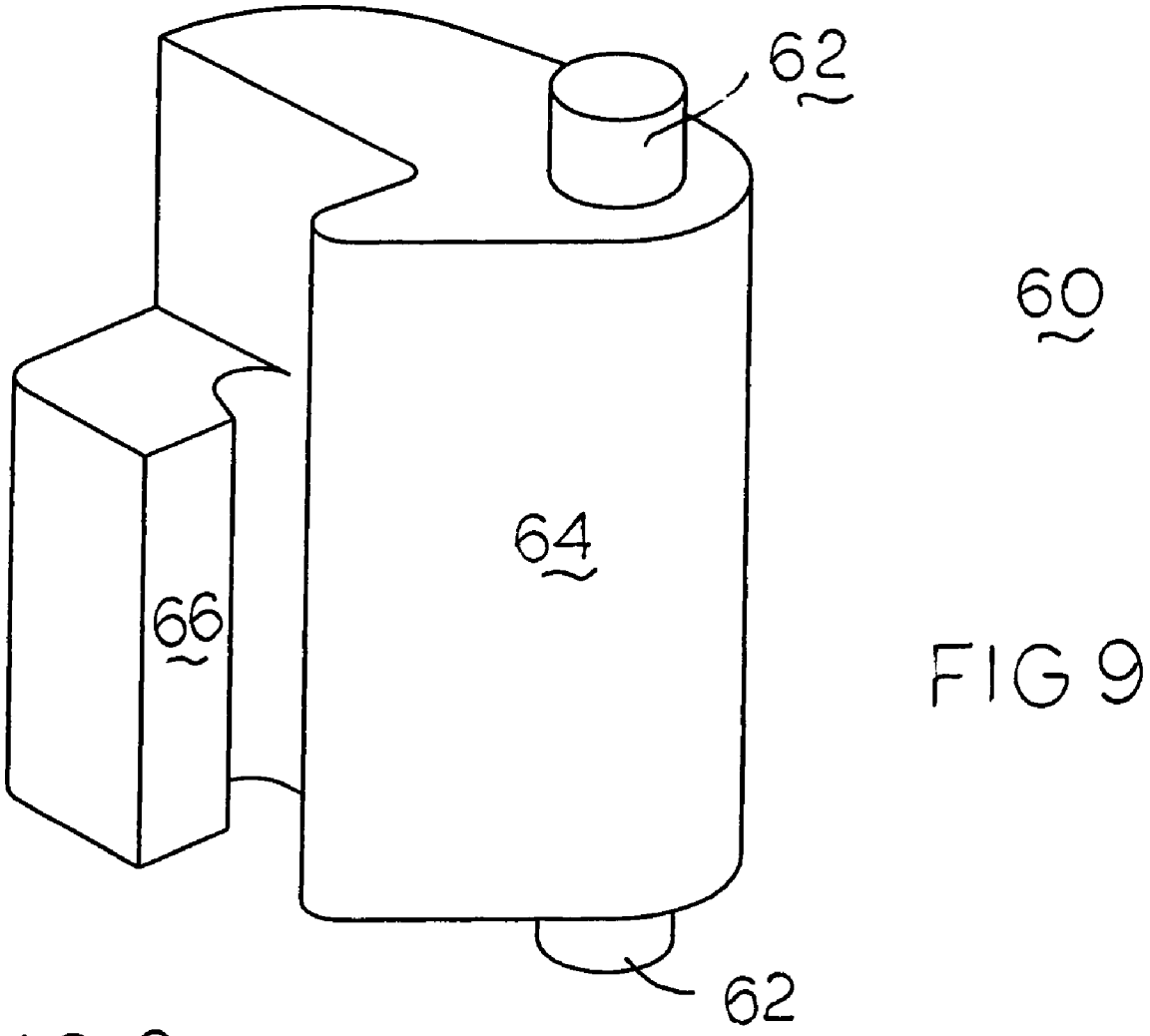
FIG. 9 is an enlarged perspective view of the locking member of FIG. 4.
Figure 10A:
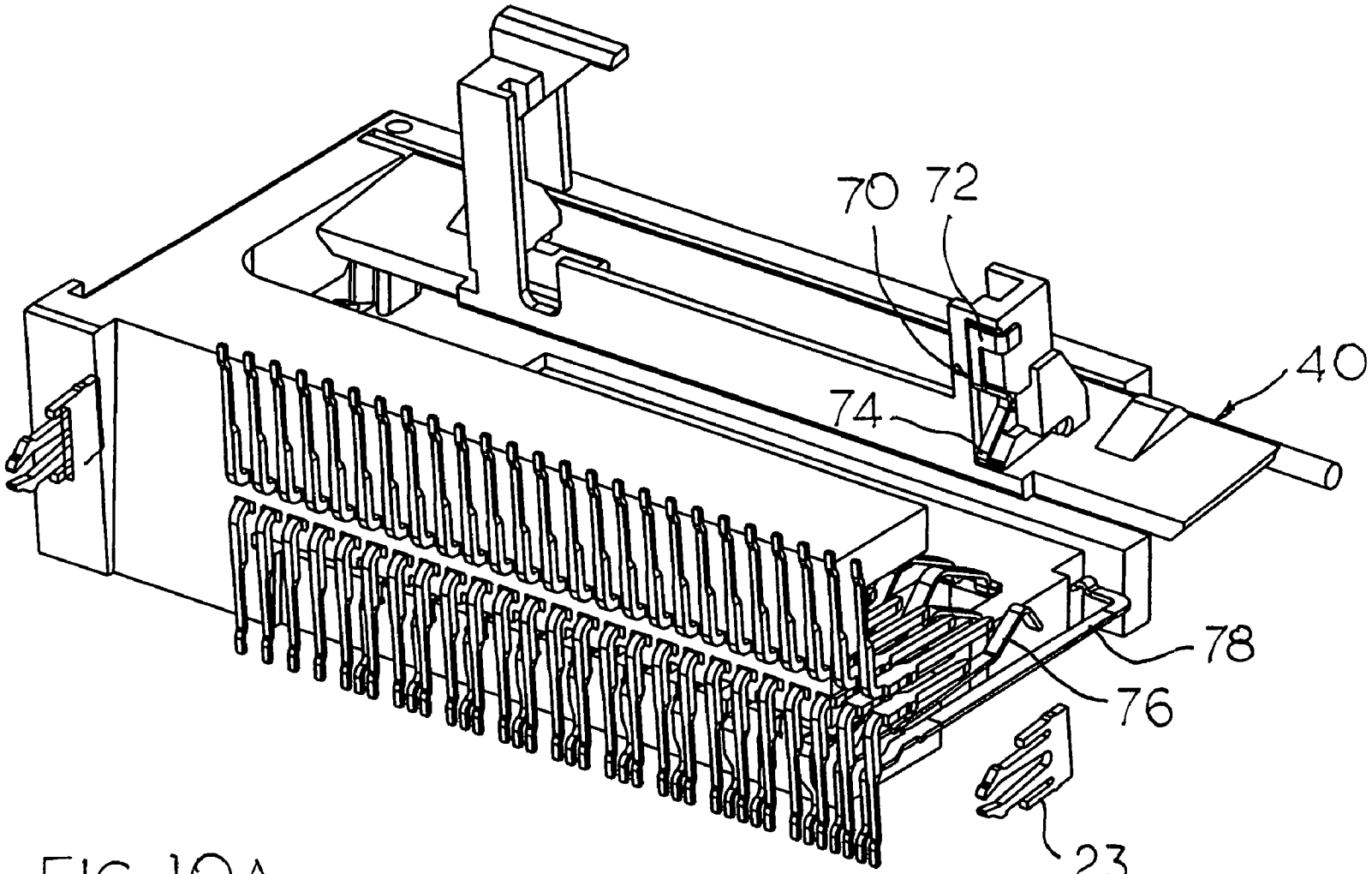
FIG. 10(A) is a partially enlarged rear perspective view of the assembled housing and protection door of FIG. 4 to show the two switch contacts on the housing and another switch contact on the protection door for illustrating operation therebetween, wherein the protection door is in the open position.
Figure 10B:
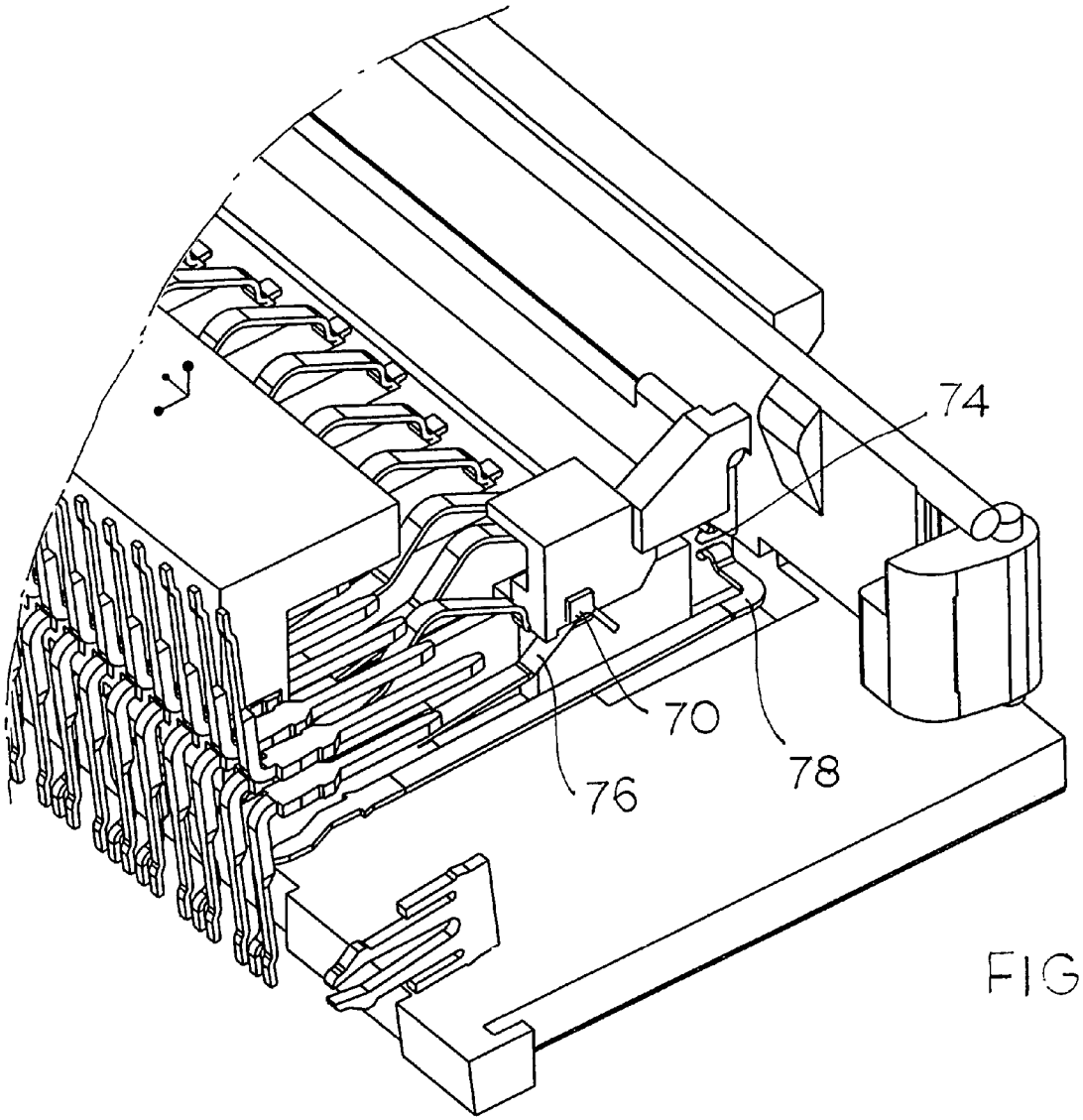
FIG. 10(B) is a partially enlarged rear perspective view of the assembled housing and protection door of FIG. 10(A) to show the two switch contacts on the housing and another switch contact on the protection door for illustrating operation therebetween, wherein the protection door is in the closed position.
Figure 11:
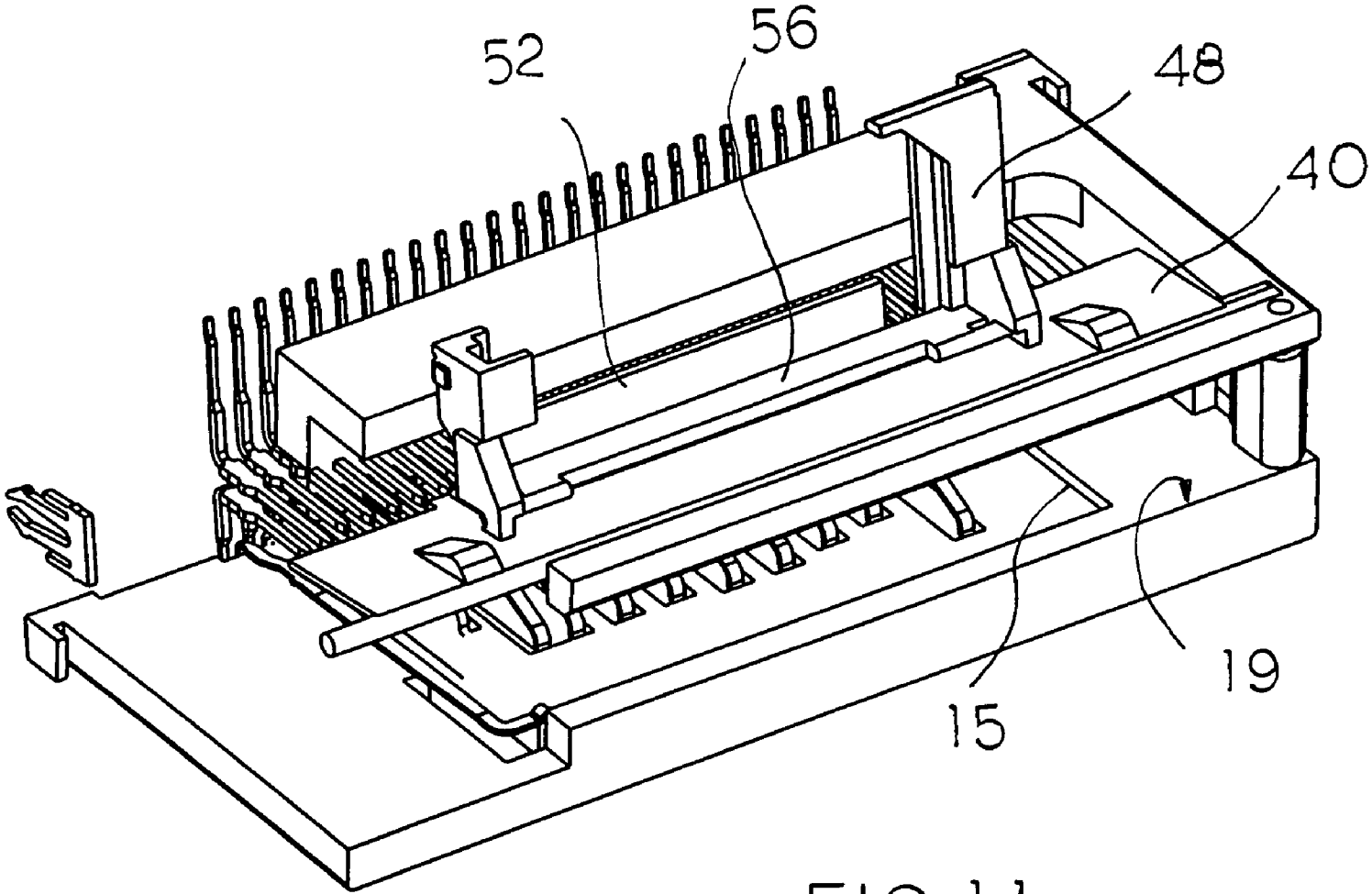
FIG. 11 is a partially enlarged front perspective view of the assembled housing and protection door of FIG. 10(B) to show how the protection door is rotated to expose the full entrance opening and have the guiding rail structure escaped and further upstanding from the receiving space.

Referring to FIGS. 8(C), 10(A) and 10(B), a moveable first switch contact 70 is associatively located on the protection door 40 having a first contact end 72 and a second contact end 74. Stationary second switch contact 76 and third switch contact 78 are disposed in the housing 10 and electrically connected to the printed circuit board 100 wherein the second switch contact 76 includes a contact section 80 adapted to engage the first contact end 72 of the moveable contact 70 when the protection door 40 is in the non-rotation position, and the third switch contact 78 adapted to be engaged with the second contact end 74 of the moveable contact 70 when the protection door 40 is in the non-rotation position and a small size card 300 pushes rearwardly away the pivotal door 56 and is inserted into the small entrance opening 46.

One feature of the invention is to provide a small entrance opening 46 within the moveable protection door 40 so as to allow insertion of the small card 300 into the receiving space 18 for mating with the corresponding contacts. Another feature of the invention is to provide the guiding rails 48 on the moveable protection door 40 for holding the inserted small card 300. Yet another feature of the invention is to provide the pivotal door 56 to block the small entrance opening 46 so as to form the so-called door-in-door structure for not only dust protection of the connector 1 but also snug guidance of the small card 300.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claim. Therefore, person of ordinary skill in this field are to understand that all such equivalent structures are to be included within the scope of the following claims.

I claim:

1. An electrical card connector for respective use with large and small size cards, comprising:

an insulating housing defining a receiving space with a large entrance opening at a front end of the housing;

first and second sets of contacts disposed in the housing in communication with the receiving space; and a protection door moveably covering said large entrance opening for receiving space; and said protection door further defines a small entrance opening therein for receiving the small card, wherein the protection door is releasably locked by a moveable locking member while can be released if the moveable locking member is actuated to move by the large size card.

2. The card connector as described in claim 1, wherein a pivotal door is associated with the protection door to moveably cover the small entrance opening.

3. The card connector as described in claim 1, wherein a guiding device is associatively formed on a back face of the protection door and in alignment with the small entrance opening for guidable insertion of the small size card.

4. The card connector as described in claim 1, wherein the said protection door is pivotally moved with regard to the housing.

5. The card connector as claimed in claim 4, wherein a metallic shield encloses the housing and includes a large opening to allow the guiding device to pass when said protection door is raised upward for receiving the large size card.

6. The card connector as claimed in claim 1, wherein a metallic shield encloses the housing and includes at least one resilient device to urge the protection door to be in an original position to cover the large entrance opening.

7. The card connector as described in claim 1, wherein a metallic shield encloses the housing and includes at least one resilient device to urge the moveable locking member to be in an original position to lock the protection door.

8. The card connector as described in claim 1, wherein a first switch contact is associated with the protection door to engage, when the protection door is in an original position, a second switch contact which is constantly dispose in the housing.

9. The card connector as described in claim 8, wherein a third switch contact is constantly disposed in the housing to engage the first switch contact when the small size card is inserted into the small entrance opening.

10. The card connector as described in claim 1, wherein said protection door includes a bottom plate cooperates with the guiding device and a pivotal door, which is pivotally associated with the protection door to moveably cover the small entrance opening, for holding the small card in position.

11. An electrical card connector for respective use with large and small size cards, comprising:

an insulating housing defining a receiving space with a large entrance opening at a front end of the housing;

first and second sets of contacts disposed in to housing in communication with the receiving space; and a protection door moveably covering said large entrance opening for receiving space; and said protection door further defines a small entrance opening therein for receiving the small card, wherein the protection door is further equipped with a guiding device in alignment with the small pivotal door for receiving the small size card.

12. An electrical card connector for respective use with an insulating housing defining a receiving space with a large entrance opening at a front end of the housing;

first and second sets of contacts disposed in the housing in communication with the receiving space; and a protection door moveably covering said large entrance opening for receiving space; and said protection door further defines a small entrance opening therein for receiving the small card, wherein a switch contact is associated with the protection door to engage at least another switch contact constantly dispose in the housing.

13. The card connector as claimed in claim 12, wherein a third switch contact is disposed in the housing and engaged with the first switch contact only when the protection door is in the original position and said at least one card is inserted into the entrance opening.

* * * * *